US012116999B2

(12) United States Patent
Guo et al.

(10) Patent No.: US 12,116,999 B2
(45) Date of Patent: Oct. 15, 2024

(54) COMPRESSOR WITH IMPROVED STRUCTURE FOR EASY INSTALLATION

(71) Applicant: Hangzhou Lvneng New Energy Vehicle Parts Co., LTD., Hangzhou (CN)

(72) Inventors: Weili Guo, Hangzhou (CN); Dawei Ge, Hangzhou (CN); Jun Ouyang, Hangzhou (CN)

(73) Assignee: HANGZHOU LVNENG NEW ENERGY VEHICLE PARTS CO., LTD., Hangzhou (CN)

( * ) Notice: Subject to any disclaimer, the term of this patent is extended or adjusted under 35 U.S.C. 154(b) by 0 days.

(21) Appl. No.: 18/399,667

(22) Filed: Dec. 28, 2023

(65) Prior Publication Data

US 2024/0218874 A1 Jul. 4, 2024

(30) Foreign Application Priority Data

Dec. 30, 2022 (CN) ..... 202211726660.9

(51) Int. Cl.
*F04C 18/02* (2006.01)
*F04C 27/00* (2006.01)

(52) U.S. Cl.
CPC ..... *F04C 18/0215* (2013.01); *F04C 27/001* (2013.01)

(58) Field of Classification Search
CPC .. F04C 18/0215; F04C 27/001; F04C 27/005; F04C 29/0057; F04C 29/028; F04C 29/02; F04C 29/12; F04C 18/0261; F04C 23/008; F04C 2240/603; F25B 1/06; F25B 49/02
USPC ..... 418/55.1–55.6
See application file for complete search history.

(56) References Cited

U.S. PATENT DOCUMENTS 8,177,534 B2 * 5/2012 Ni ..... F04C 18/0215 418/91
11,193,476 B2 * 12/2021 Cho ..... F04C 2/086
11,859,872 B2 * 1/2024 Varga ..... F25B 1/06

FOREIGN PATENT DOCUMENTS

CN 214469429 U 10/2021
WO WO-2021179571 A1 * 9/2021

OTHER PUBLICATIONS

Machine Translation WO-2021179571-A1 (Year: 2024).*

* cited by examiner

*Primary Examiner* — Dapinder Singh
(74) *Attorney, Agent, or Firm* — Cheng-Ju Chiang

(57) ABSTRACT

A compressor includes a fixed scroll, a movable scroll and a cover body. The cover body has an injection hole. The compressor has a compression chamber which is at least partially located between the fixed scroll and the movable scroll. The compressor includes a communication tube which defines a communication channel in communication with the enthalpy increasing channel. One end of the communication tube is at least partially located in the enthalpy increasing channel. A circumferential side wall of the one end of the communication tube is directly or indirectly in contact with an inner wall of the enthalpy increasing channel. Another end of the communication tube is at least partially located within the injection hole. A circumferential side wall of the another end of the communication tube is directly or indirectly in contact with an inner wall of the injection hole.

20 Claims, 9 Drawing Sheets

COMPRESSOR WITH IMPROVED STRUCTURE FOR EASY INSTALLATION

CROSS-REFERENCE TO RELATED APPLICATION

This patent application claims priority of a Chinese Patent Application No. 202211726660.9, filed on Dec. 30, 2022 and titled "COMPRESSOR", the entire content of which is incorporated herein by reference.

TECHNICAL FIELD

The present disclosure relates to the technical field of compressors, and in particular, to a compressor.

BACKGROUND

A compressor is configured to compress a low-pressure and low-temperature refrigerant gas into a high-pressure and high-temperature refrigerant gas. The main compression components of a scroll compressor are a fixed scroll and a movable scroll which are meshed to form a compression chamber so as to compress the incoming gas. In the related art, in order to prevent excessive pressure in the compression chamber from causing damage to components of the compressor, a static plate is set to float along its axial direction. At the same time, through the jet technology, a certain amount of gas is introduced from an outlet of a condenser of a refrigeration cycle and injected into the compression chamber through a guide device. The guide device is disposed between a casing of the compressor and the fixed scroll to reduce the temperature of the discharge gas. However, due to the floating of the static plate, the structure of the guide device will be very complicated in order to ensure the effective introduction of the gas.

SUMMARY

The present disclosure provides a compressor with a simple structure and easily to be installed.

A compressor includes a fixed scroll, a movable scroll and a cover body. The cover body defines an injection hole. The cover body and a hole wall of the injection hole are of one piece. The compressor defines a compression chamber which is at least partially located between the fixed scroll and the movable scroll. The fixed scroll defines an enthalpy increasing channel. The enthalpy increasing channel and the compression chamber are capable of being in communication. The compressor includes a communication tube which defines a communication channel. The communication channel is in communication with the enthalpy increasing channel. One end of the communication tube is at least partially located in the enthalpy increasing channel. A circumferential side wall of the one end of the communication tube is directly or indirectly in contact with an inner wall of the enthalpy increasing channel. Another end of the communication tube is at least partially located within the injection hole. A circumferential side wall of the another end of the communication tube is directly or indirectly in contact with an inner wall of the injection hole.

In the present disclosure, the cover body and the hole wall of the injection hole are of one piece. The one end of the communication tube is at least partially located in the enthalpy increasing channel. The one end of the communication tube is directly or indirectly in contact with the inner wall of the enthalpy increasing channel. The another end of the communication tube is at least partially located in the injection hole. The another end of the communication tube is directly or indirectly in contact with the inner wall of the injection hole, so that the communication tube connects the enthalpy increasing channel and the injection hole, making the structure is simpler and the installation is more convenient.

DETAILED DESCRIPTION

Figure 1:
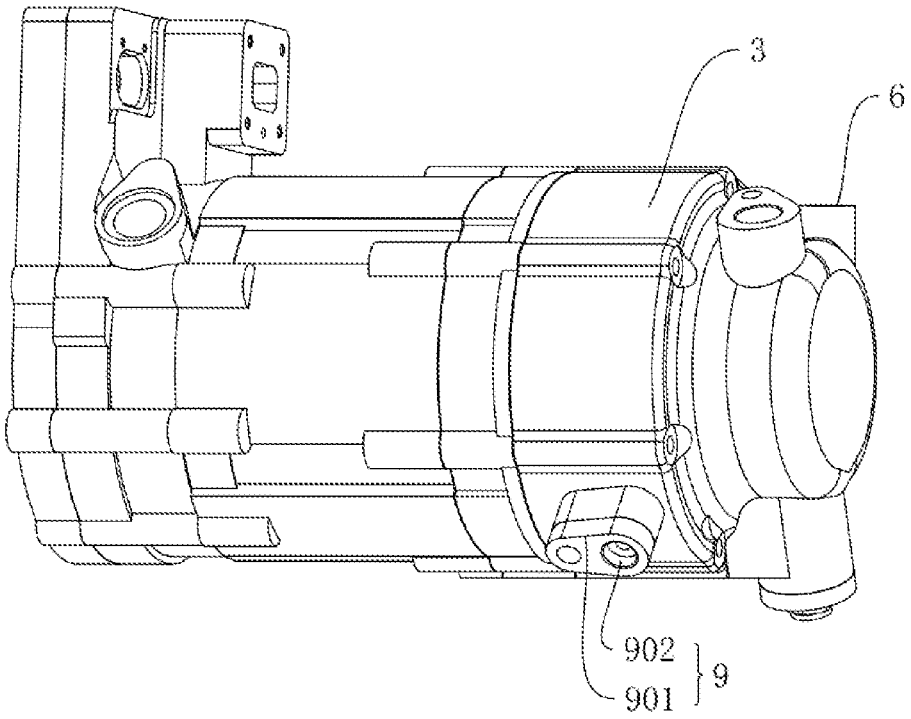
FIG. 1 is a perspective view of a compressor in accordance with an embodiment of the present disclosure.
Figure 2:
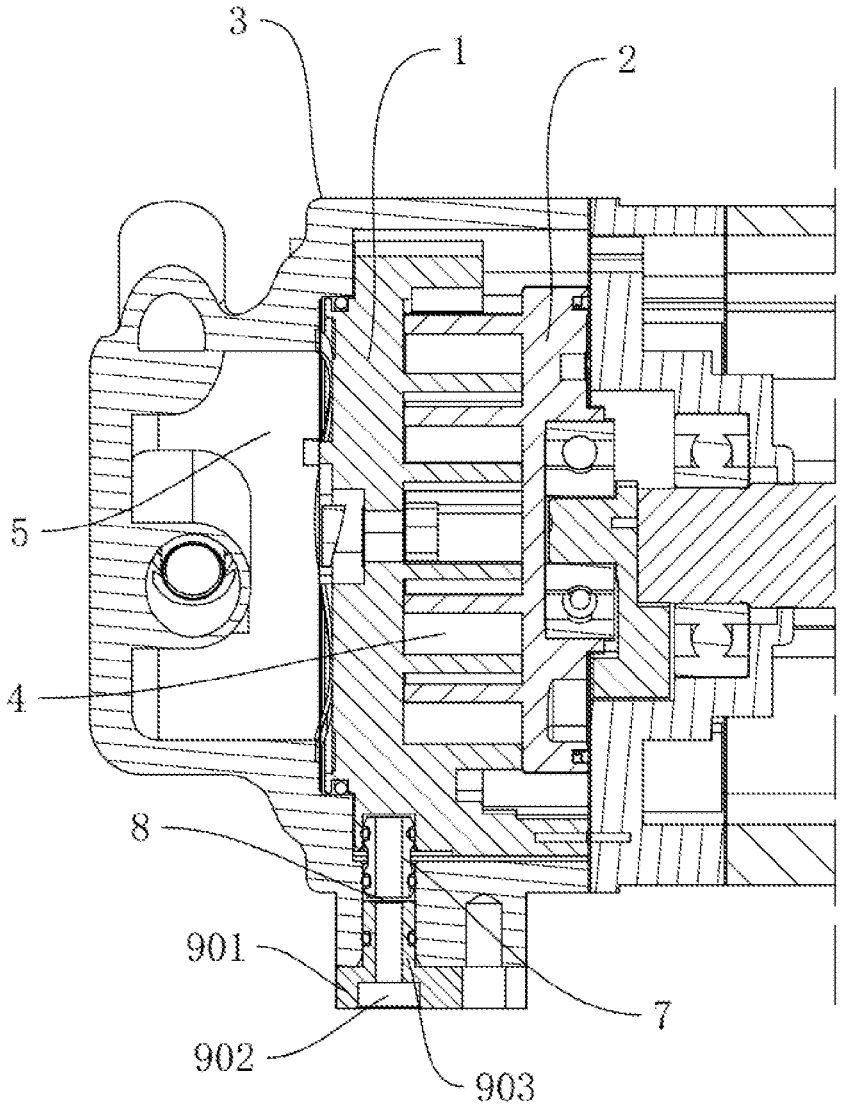
FIG. 2 is a partial cross-sectional view of the compressor in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

As shown in FIG. 1 to FIG. 10, the present disclosure provides a compressor including a fixed scroll 1, a movable scroll 2 and a cover body 3. The compressor defines a compression chamber 4 and a high-pressure chamber 5. The compression chamber 4 is at least partially located between the fixed scroll 1 and the movable scroll 2. The high-pressure chamber 5 is at least partially located between the fixed scroll 1 and the cover body 3. The high-pressure chamber 5 and the compression chamber 4 are capable of being in communication. The compressor includes a temperature-conducting portion 6. The temperature-conducting portion 6 and the cover body 3 are of one piece. The temperature-conducting portion 6 is at least partially located in the high-pressure chamber 5. The temperature-conducting portion 6 has an accommodation cavity 601. The compressor includes a temperature-sensing portion 10 which is at least partially located in the accommodation cavity 601.

When the compressor compresses a refrigerant gas, it mainly relies on the mutual cooperation between the fixed scroll 1 and the movable scroll 2. In a radial direction of the fixed scroll 1, the refrigerant gas is continuously compressed from an outside toward a center of the fixed scroll 1. After the compression is completed, the compressed high-temperature and high-pressure gas is discharged from the compression chamber 4 to the high-pressure chamber 5. At this time, the temperature-sensing portion 10 located in the accommodation cavity 601 can monitor the temperature in the high-pressure chamber 5.

Since the temperature-conducting portion 6 is at least partially located in the high-pressure chamber 5, after the temperature-sensing portion 10 is installed in the accommodation cavity 601, the temperature-sensing portion 10 can monitor the gas discharged from the compression chamber 4. The temperature-conducting portion 6 and the cover body 3 are still of one piece, which makes the overall structure simpler. The temperature-sensing portion 10 is also very convenient to install. It only needs to insert the temperature-sensing portion 10 into the accommodation cavity 601. If the solution in the related art is adopted, the installation point of the temperature-sensing portion 10 is set on an end surface outside the cover body 3, which will make the monitoring results inaccurate, and thus the liquid ejection effect cannot achieve the expected effect. Alternatively, a through hole may be opened on the cover body 3, and the temperature-sensing portion 10 is placed inside a tube body and inserted into the high-pressure chamber 5, or even a hole is opened on the fixed scroll 1 and the temperature-sensing portion 10 is inserted into the compression chamber 4. Although the monitoring results in this way are more accurate, the structure will be more complicated. It is not only necessary to open the holes on the cover body 3 and the fixed scroll 1, but also to consider the sealing between the compression chamber 4 and the high-pressure chamber 5, and the sealing between the high-pressure chamber 5 and the outside of the compressor. Production costs will increase significantly and the installation process will become more complicated.

When the compressor is in working condition, the fixed scroll 1 and the movable scroll 2 in the compressor cooperate to compress the refrigerant gas into a high-temperature and high-pressure gas, which is then discharged and condensed into a liquid refrigerant through a condenser. After the liquid refrigerant is discharged, the liquid refrigerant is throttled into a mist through an expansion valve and then enters an evaporator to absorb heat. The refrigerant is converted into a gaseous refrigerant and then enters the compressor for circulation.

As shown in FIG. 1 to FIG. 4, FIG. 8 and FIG. 9, the cover body 3 defines an injection hole 301. The compressor includes a valve member 11 which is fixed at an opening of the injection hole 301.

The temperature-sensing portion 10 can monitor the temperature in the high-pressure chamber 5 to control the opening and closing of a valve core of the valve member 11. When the temperature-sensing portion 10 detects that the temperature reaches a preset value, it controls the valve core to open. If the temperature continues to rise, the degree of opening and closing of the valve core will also increase so as to increase the flow rate, thereby effectively reducing the temperature of the discharge gas. In addition, since the valve member 11 is directly fixed to the injection hole 301, not only the installation of connecting pipelines is reduced, but also the development and design work of the compressor manufacturer is reduced.

In an embodiment, the valve member 11 includes a thermal control valve. The thermal control valve includes a temperature-sensing portion 10 which is a temperature-sensing package. The temperature-sensing package is part of the thermal control valve. The thermal control valve defines an introduction channel and an ejection channel. The ejection channel is in communication with the injection hole 301.

The thermal control valve can directly provide feedback through the temperature results monitored by the temperature-sensing portion 10 so as to open or close the valve core. The introduction channel is in communication with an outlet of the condenser. When the temperature-sensing package detects that the temperature in the high-pressure chamber 5 is too high, the temperature-sensing package controls the opening of the valve core through the heat conduction effect, and the control effect is more direct. Then the liquid refrigerant discharged from the outlet of the condenser can enter the thermal control valve from the introduction channel, and then be discharged from the ejection channel. Due to the communication between the ejection channel and the injection hole 301, it can be introduced from the injection hole 301 and then into the compression chamber 4 so as to reduce the temperature of the gas discharged from the compression chamber 4. Since the liquid refrigerant is introduced, the cooling effect is better. In addition, since the valve opening temperature is adjustable, it can be suitable for different refrigerants and different applications.

In another embodiment, the valve member 11 includes an electronic expansion valve to which a controller is connected. The temperature-sensing portion 10 is a temperature sensor. The controller is further electrically connected to the temperature sensor. In this embodiment, the thermal control valve can be replaced by an electronic expansion valve, and in this case, the controller needs to be provided. When the temperature sensor detects that the temperature of the high-pressure chamber 5 reaches a preset value, it will send a signal to the controller. After receiving the signal, the controller controls the opening of the valve core, which can ultimately reduce the temperature of the discharged gas.

As shown in FIG. 3 to FIG. 5 and FIG. 10, the fixed scroll 1 includes a bottom plate 101 and a spiral wall 102. The bottom plate 101 defines an enthalpy increasing channel 103. Two ends of the enthalpy increasing channel 103 are in communication with the injection hole 301 and the compression chamber 4, respectively. After the valve member injects the refrigerant liquid from the injection hole 301, the enthalpy increasing channel 103 in communication with the injection hole 301 introduces the liquid into the compression chamber 4.

Figure 3:
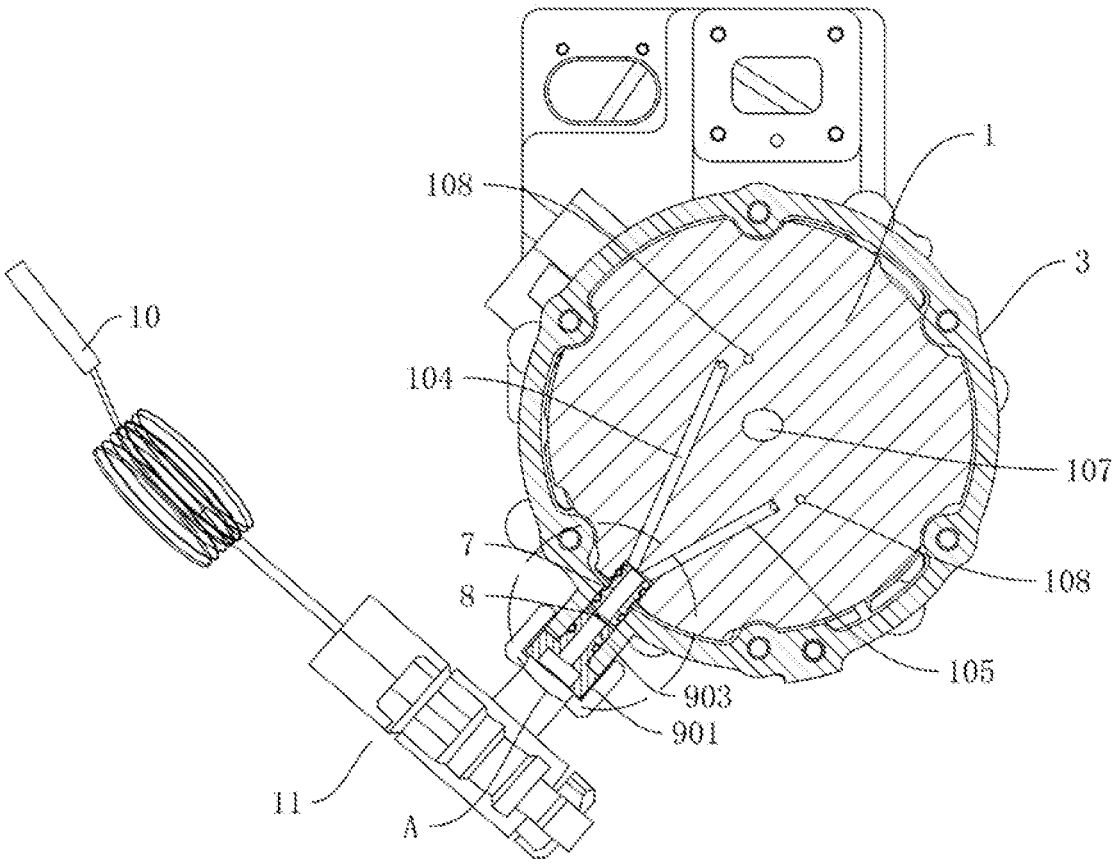
FIG. 3 is a cross-sectional view of the compressor in accordance with an embodiment of the present disclosure.
Figure 4:
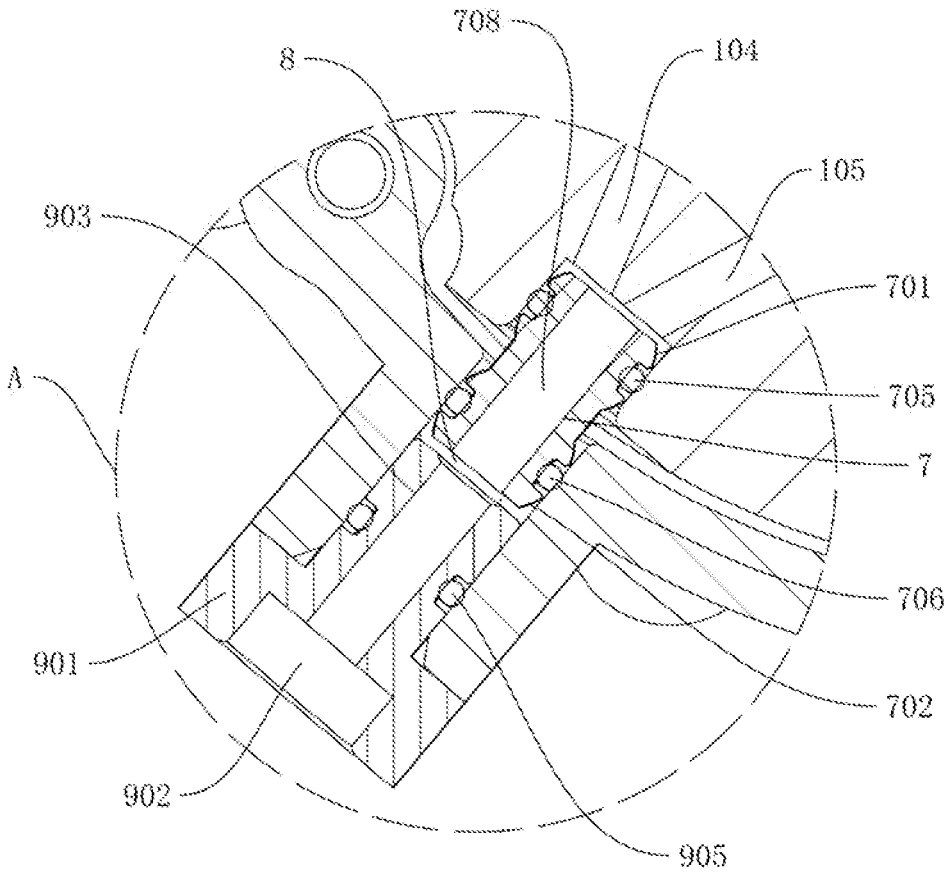
FIG. 4 is an enlarged view of circle A in FIG. 3.
Figure 5:
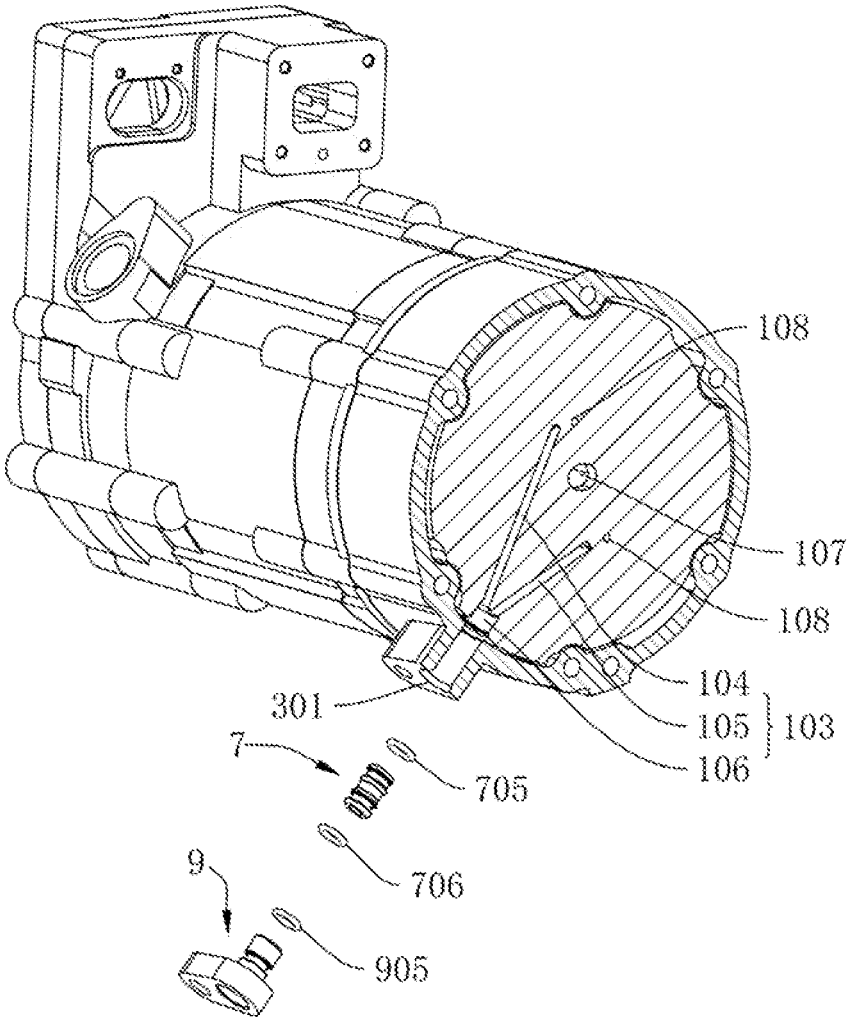
FIG. 5 is a perspective exploded view of the compressor in accordance with an embodiment of the present disclosure.

As shown in FIG. 3 to FIG. 5, the enthalpy increasing channel 103 includes a first channel 104 and a second channel 105. An inlet of the first channel 104 and an inlet of the second channel 105 are both in communication with the injection hole 301. An outlet of the first channel 104 and an outlet of the second channel 105 are both in communication with the compression chamber 4.

Compared with a single channel arrangement in the related art, the first channel 104 and the second channel 105 can increase the amount of liquid introduced, thereby effectively reducing the temperature of the discharged gas. On the other hand, it is used to introduce liquid into different positions of the compression chamber 4, which can also effectively reduce the temperature of the discharged gas. In the radial direction of the fixed scroll 1, the gas compressed by the compression chamber 4 will be gradually compressed from the outside to the inside, and the pressure and temperature will continue to increase as the compression proceeds. After the liquid is introduced into the compression chamber 4 from two different positions, the temperature and pressure of the gas at different positions are different. It can be mixed with the liquid at different pressures and temperatures, which can improve the adequacy of mixing and effectively cool the discharged gas.

Among them, the enthalpy increasing channel 103 further includes a third channel 106. One end of the third channel 106 extends through a circumferential side wall of the bottom plate 101. The inlets of the first channel 104 and the second channel 105 are both in communication with the third channel 106.

The function of the third channel 106 is to introduce the liquid entering from the injection hole 301 into the third channel 106 first, and then split the liquid from the third channel 106 into the first channel 104 and the second channel 105. If there is no third channel 106, since the first channel 104 and the second channel 105 need to introduce the injected liquid, the inlets of the first channel 104 and the second channel 105 will form two through holes on the circumferential side wall of the bottom plate 101 to communicate with the injection hole 301, but this will increase the risk of leakage and make sealing more difficult.

In addition, as shown in FIG. 3, the bottom plate 101 has a gas discharge hole 107, and the outlet of the first channel 104 and outlet of the second channel 105 are located on two sides of the gas discharge hole 107, respectively.

By providing the outlet of the first channel 104 and the outlet of the second channel 105 being respectively located on two sides of the gas discharge hole 107, when the introduced liquid is introduced into different positions in the compression chamber 4, it is as far apart as possible, which can improve the cooling effect. If the outlet of the first channel 104 and the outlet of the second channel 105 are located on the same side of the gas discharge hole 107, and the positions of the outlets are close to each other, the liquid introduced at this time is located at the same position of the compression chamber 4. At this time, the adequacy of mixing will be much worse than if the introduced liquid is diverted to different positions of the compression chamber 4.

As shown in FIG. 2 to FIG. 7, the compressor includes a communication tube 7 which is in communication with the third channel 106 and the injection hole 301. One end of the communication tube 7 is at least partially located in the third channel 106, and the other end of the communication tube 7 is at least partially located in the injection hole 301.

Since the fixed scroll 1 and the cover body 3 are not integrally formed, there will be a gap between them after assembly. At this time, although the third channel 106 and the injection hole 301 are in a state of communication, leakage will occur when liquid is introduced at this time. The function of the communication tube 7 is to make up for the gap between the fixed scroll 1 and the cover body 3. By placing the two ends of the communication tube 7 in the injection hole 301 and the third channel 106, respectively, and then only sealing is required at two ends of the communication tube 7 in order to prevent leakage. The liquid is introduced from the injection hole 301 into the third channel 106 through the communication tube 7. If there is no third channel 106 that plays a relay role, it is difficult for the communication tube 7 to directly communicate with the first channel 104 and the second channel 105, and it is also difficult to ensure that the sealing property does not leak at the same time. The third channel 106 not only facilitates the connection of the communication tube 7 and the introduction of liquid, but also reduces the difficulty of sealing.

As shown in FIG. 3 or FIG. 5, the bottom plate 101 has a through hole 108 which is in communication with the compression chamber 4 and the high-pressure chamber 5. The function of the through hole 108 is for early gas discharge. During the process of compressing gas in the compression chamber 4, the pressure may be too high, which may cause damage to the fixed scroll 1 and the movable scroll 2 or the internal structure of the compressor. The through hole 108 can be used for early gas discharge when the pressure in the compression chamber 4 is too high, and part of the high-pressure gas can be discharged into the high-pressure chamber 5. Under normal compression, the through hole 108 is sealed by an elastic valve plate provided on one side of the bottom plate 101. The elastic valve plate is located in the high-pressure chamber 5. When the pressure of the compressed gas is too high, the gas will press the elastic valve plate to break away from blocking the through hole 108, thereby discharging part of the gas for decompression. When the pressure returns to normal, the elastic valve plate will continue to block the through hole 108 under the action of elastic force.

The bottom plate 101 has two through holes 108 which are located on two sides of the gas discharge hole 107, respectively, so that the through holes 108 communicate with different positions of the compression chamber 4. During the process of compressing gas, a position where the pressure is too high in the compression chamber 4 is not fixed. However, by providing the through holes 108 on the two sides of the gas discharge hole 107, when the pressure is too high, it can be discharged from one of the through holes 108 in time.

When the gas is compressed in the compression chamber 4, the compressed gas will make a circular motion along a profile line of the spiral wall 102. If the through holes 108 are provided on the same side and close to each other, when the fixed scroll 1 and the movable scroll 2 cooperate with the compressed gas and the pressure is too high just after passing through the position of the through hole 108, at this time, the high-pressure gas still needs to travel a long path to reach the position of the gas discharge hole 107 before being discharged. During this process, the pressure will continue to increase, which will increase the damage to the fixed scroll 1, the movable scroll 2 or the compressor structure. Or, if the pressure in the compression chamber 4 is too high at a location far away from the through hole 108, the gas with the same high pressure still needs to travel a long path to reach the location of the through hole 108 for being discharged early. During this process, the pressure of the high-pressure gas is still increasing, which will still increase the damage to the fixed scroll 1, the movable scroll 2 or the compressor structure. In this solution, if the two through holes 108 are respectively provided on two sides of the gas discharge hole 107, no matter where the pressure is too high in the compression chamber 4, the position of the through hole 108 can be reached quickly for early discharge or the position of the gas discharge hole 107 can be reached quickly for direct gas discharge.

In another embodiment, the cover body 3 and a hole wall of the injection hole 301 are integrated of one piece. The communication tube 7 defines a communication channel 708 that communicates with the enthalpy increasing channel 103. One end of the communication tube 7 is at least partially located in the enthalpy increasing channel 103. The one end of the communication tube 7 is in contact with an inner wall of the enthalpy increasing channel 103. Another end of the communication tube 7 is at least partially located in the injection hole 301. The another end of the communication tube 7 is in contact with an inner wall of the injection hole 301.

A peripheral wall of the communication tube 7 includes a first extension portion 701 which is of an annular configuration. The first extension portion 701 is at least partially located in the enthalpy increasing channel 103. The peripheral wall of the communication tube 7 includes a second extension portion 702 which is of an annular configuration. The second extension portion 702 is at least partially located in the injection hole 301. In a plane where a centerline of the communication tube 7 lies, circumferential outer surfaces of the first extension portion 701 and the second extension portion 702 are of arc-shaped configurations. The first extension portion 701 has a first sealing groove 703, and the second extension portion 702 has a second sealing groove 704. The compressor further includes a first sealing ring 705 at least partially located in the first sealing groove 703 and a second sealing ring 706 at least partially located in the second sealing groove 704.

In traditional related technologies, during the gas compression process, the pressure will be too high, which will affect the stability of the structure and thus the compression efficiency. Compressors are therefore often configured to be axially flexible along their axial direction. That is, the fixed scroll 1 is movable axially in the axial direction of the fixed scroll 1. Therefore, when the pressure in the compression chamber 4 is too high, the intermeshing fixed scroll 1 and the movable scroll 2 can temporarily move away from each other to relieve the pressure and avoid component damage. Since the two ends of the communication tube 7 need to be connected to the bottom plate 101 of the fixed scroll 1 and the cover body 3, respectively, if the two ends of the communication tube 7 are fixedly connected, the communication tube 7 will be easily damaged, resulting in leakage of the introduced liquid.

The first extension portion 701 and the second extension portion 702 are respectively located at two ends of the communication tube 7 and protrude beyond the circumferential side wall of the communication tube 7. The circumferential outer surfaces of the first extension portion 701 and the second extension portion 702 are also of arc-shaped configuration. Therefore, when the first extension portion 701 and the second extension portion 702 of the communication tube 7 are placed in the enthalpy increasing channel 103 and the injection hole 301 respectively, and when the fixed scroll 1 moves, the two ends of the communication tube 7 will also move due to the arc-shaped configurations. The first extension portion 701 and the second extension portion 702 are rotatable relative to each other. In a preferred solution, the circumferential outer surfaces of the first extension portion 701 and the second extension portion 702 are circular, which has the best effect. At this time, the rotation range is also the largest. Two ends of the communication tube 7 are sealed by a first sealing ring 705 and a second sealing ring 706, respectively. The first sealing ring 705 will be in close contact with the inner wall of the third channel 106. The second sealing ring 706 will be in close contact with the inner wall of the injection hole 301. Even if the communication tube 7 rotates driven by the fixed scroll 1, the sealing performance and the function of guiding liquid will not be affected.

Figure 6:
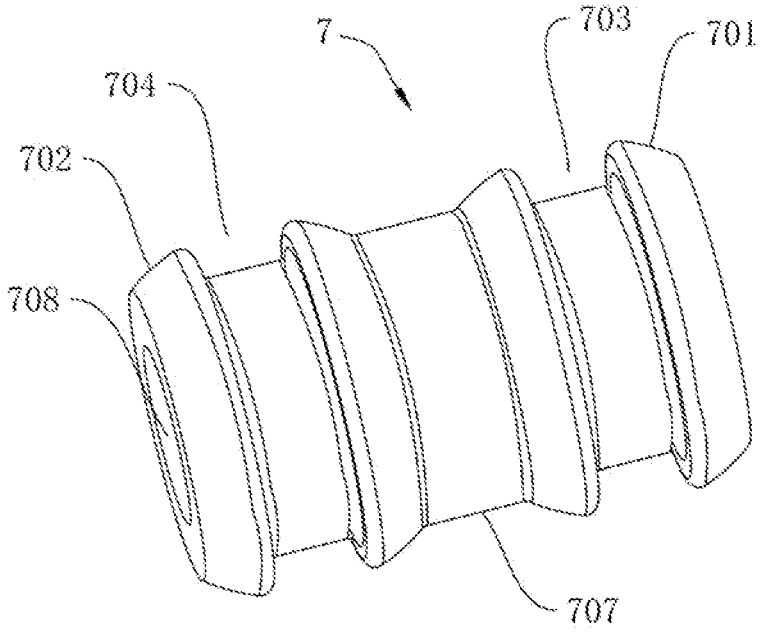
FIG. 6 is a perspective view of a communication tube in accordance with an embodiment of the present disclosure.

As shown in FIG. 6, the communication tube 7 has a connecting section 707 located between the first extension portion 701 and the second extension portion 702. A diameter of the connecting section 707 is smaller than a minimum diameter of the first extension portion 701. The diameter of the connecting section 707 is also smaller than a minimum diameter of the second extension portion 702.

On the one hand, the function of the connecting section 707 is to lengthen the overall length of the communication tube 7 and prevent the first extension portion 701 and the second extension portion 702 from being insufficiently placed in the third channel 106 and the injection hole 301, respectively. On the other hand, the connecting section 707 can also avoid an opening of the third channel 106 and an opening of the injection hole 301. When the fixed scroll 1 moves, although the communication tube 7 will rotate accordingly, the opening of the third channel 106 and the opening position of the injection hole 301 will not rotate. If the diameters on the circumferential side walls of the communication tube 7 are uniform, it is easy for the opening of the third channel 106 and the opening position of the injection hole 301 to collide with the circumferential side wall of the communication tube 7, thereby easily damaging the communication tube 7. The diameter of the connecting section 707 is smaller than that of the first extension portion 701 and that of the second extension portion 702, so that a certain avoidance section is formed outside the connecting section 707 to prevent collision.

As shown in FIG. 1 to FIG. 5, the compressor includes an adapter portion 9, which is at least partially located at the opening of the injection hole 301. In the axial direction of the communication tube 7, the adapter portion 9 is used to limit the position of the communication tube 7.

Since the communication tube 7 is not fixedly connected by welding, riveting or other methods, it may be easy to fall off. In an embodiment of the present disclosure, the adapter portion 9 is located at the opening of the injection hole 301 to limit the position of the communication tube 7. As a result, the communication tube 7 can be prevented from coming out and causing subsequent inability to introduce liquid.

Figure 7:
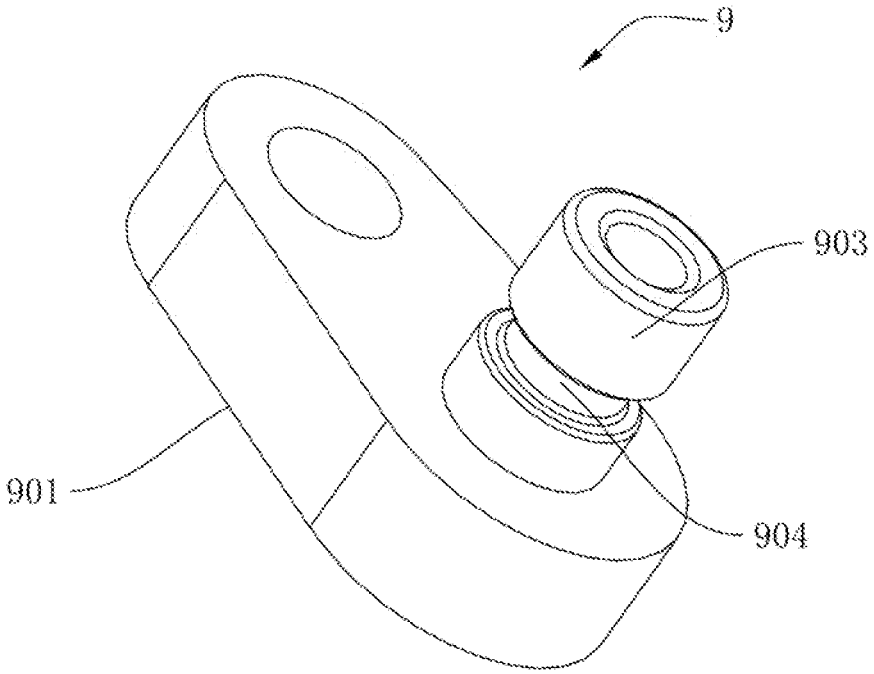
FIG. 7 is a perspective view of an adapter portion in accordance with an embodiment of the present disclosure.
Figure 8:
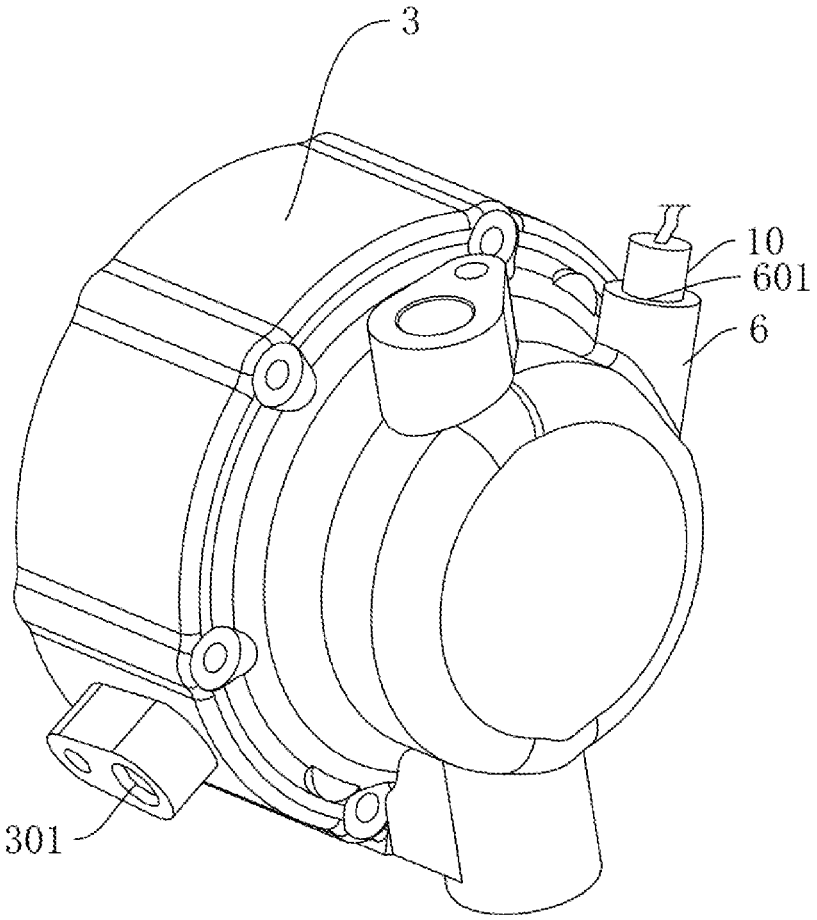
FIG. 8 is a perspective view of a cover body in accordance with an embodiment of the present disclosure.
Figure 9:
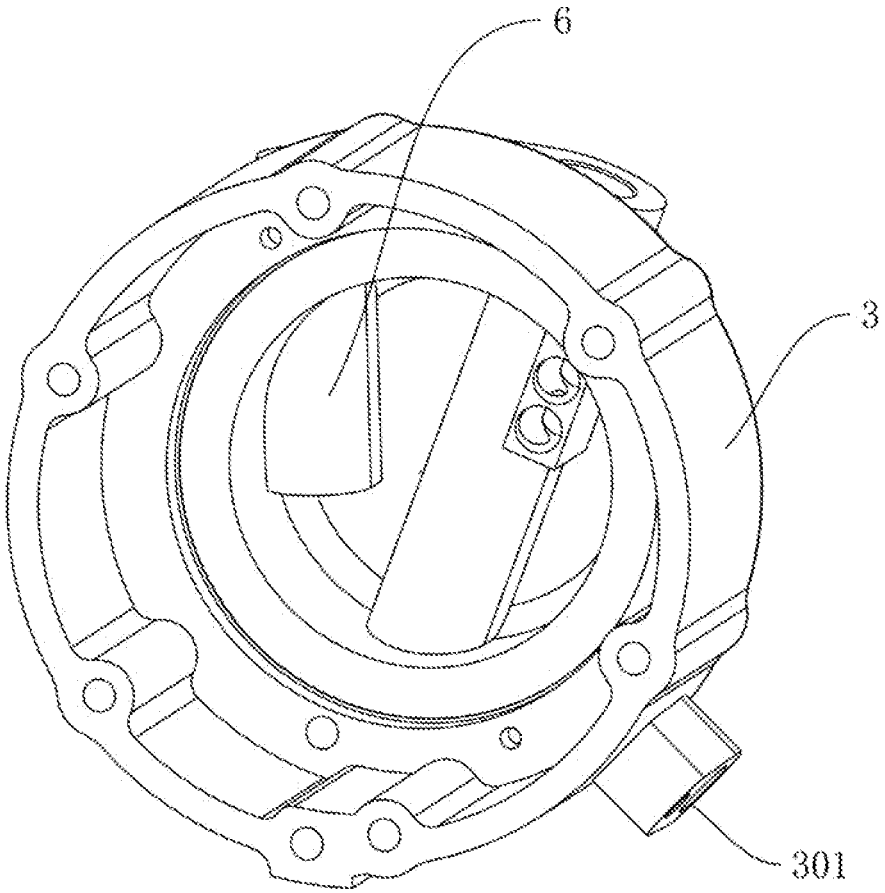
FIG. 9 is another perspective view of the cover body in accordance with an embodiment of the present disclosure.
Figure 10:
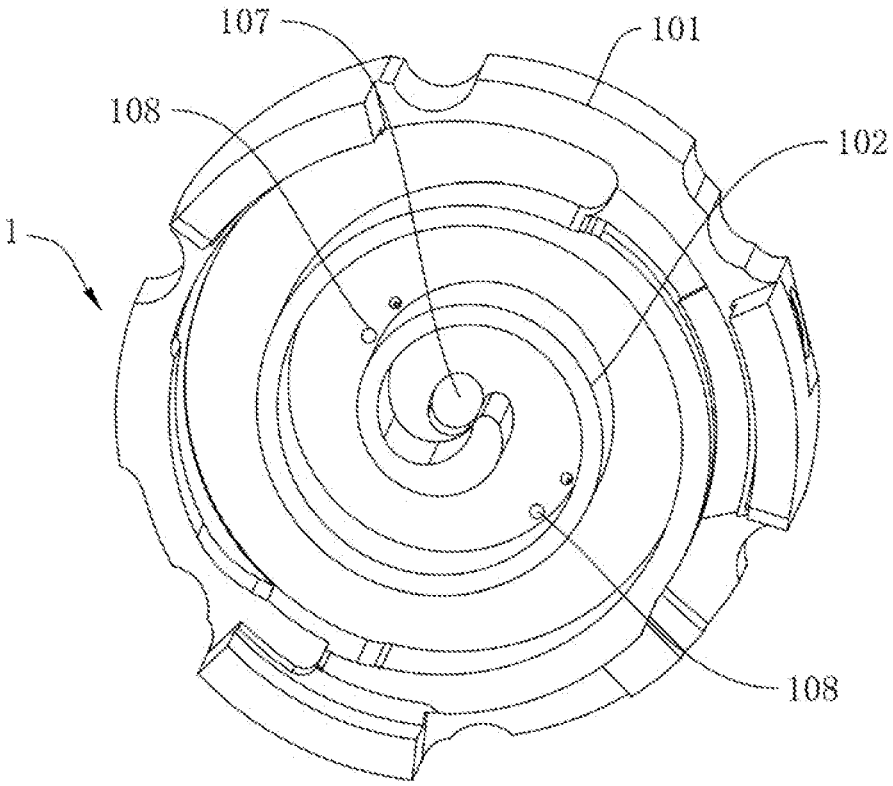
FIG. 10 is another perspective view of a fixed scroll in accordance with an embodiment of the present disclosure.

As shown in FIG. 7, the adapter portion 9 includes a pressing plate 901 which defines a plug-in port 902. The plug-in port 902 is at least partially in communication with the communication channel 708. The pressing plate 901 is fixed to an outer wall of the injection hole 301.

The pressing plate 901 can effectively prevent the communication tube 7 from coming out. The plug-in port 902 provided on the pressing plate 901 is also to facilitate its connection with an outlet of the valve member 11 so that liquid can be injected smoothly.

In addition, in one embodiment, the adapter portion 9 includes a connecting tube 903, and a tube cavity of the connecting tube 903 is in communication with the plug-in port 902. The connecting tube 903 is at least partially located in the injection hole 301.

The communication tube 7 needs to have a certain length, but its length should not be too long. If the length is too long, it will easily result in the inability to rotate correspondingly with the movement of the fixed scroll 1. At this time, if the length of the injection hole 301 is also long, the first extension portion 701 will easily come out of the third channel 106. The connecting tube 903 can prevent such a situation from occurring and limit the position of the communication tube 7 to prevent it from falling out.

As shown in FIG. 4, the compressor has a gap 8 located between the connecting tube 903 and the communication tube 7.

Since the fixed scroll 1 and the cover body 3 are not of one piece, there is also a certain distance between them in the radial direction of the fixed scroll 1. The fixed scroll 1 can therefore also move in its radial direction, which in turn will drive the communication tube 7 to move in its radial direction. The gap 8 provides a space for the communication tube 7 to move, so that the communication tube 7 will not be damaged by collision with other components.

As shown in FIG. 4 and FIG. 5, the circumferential side wall of the connecting tube 903 has an accommodating groove 904 which is located in the injection hole 301. The compressor includes a third sealing ring 905 which is at least partially located in the accommodating groove 904.

Since the connecting tube 903 is located in the injection hole 301, if the sealing performance cannot be guaranteed, the injected liquid will flow out from the gap between the connecting tube 903 and the injection hole 301. The function of the accommodating groove 904 is to facilitate the connection of the third sealing ring 905 on the one hand, and also to limit the position of the third sealing ring 905. On the other hand, the accommodating groove 904 has better sealing performance than directly sleeving the third sealing ring 905 to the connecting tube 903.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A compressor, comprising:

a fixed scroll;

a movable scroll; and a cover body; the cover body defining an injection hole; the cover body and a hole wall of the injection hole being of one piece;

wherein the compressor defines a compression chamber which is at least partially located between the fixed scroll and the movable scroll;

the fixed scroll defines an enthalpy increasing channel; the enthalpy increasing channel and the compression chamber are capable of being in communication; the compressor comprises a communication tube which defines a communication channel; the communication channel is in communication with the enthalpy increasing channel; one end of the communication tube is at least partially located in the enthalpy increasing channel; a circumferential side wall of the one end of the communication tube is directly or indirectly in contact with an inner wall of the enthalpy increasing channel; another end of the communication tube is at least partially located within the injection hole; a circumferential side wall of the another end of the communication tube is directly or indirectly in contact with an inner wall of the injection hole;

a peripheral wall of the communication tube comprises a first extension portion and a second extension portion;

the enthalpy increasing channel comprises a first channel, a second channel and a third channel; inlets of the first channel and the second channel are both in communication with the third channel; an outlet of the first channel and an outlet of the second channel are in communication with the compression chamber; the first extension portion is at least partially located in the third channel; the second extension portion is at least partially located in the injection hole.

2. The compressor according to claim 1, wherein the compressor comprises a first sealing ring and a second sealing ring;

the circumferential side wall of the one end of the communication tube is connected to the first sealing ring; the first sealing ring is connected to the inner wall of the enthalpy increasing channel;

the circumferential side wall of the another end of the communication tube is connected to the second sealing ring; the second sealing ring is connected to the inner wall of the injection hole.

3. The compressor according to claim 2, wherein the first extension portion is of an annular configuration; the second extension portion is of an annular configuration;

in a plane where a centerline of the communication tube lies, circumferential outer surfaces of the first extension portion and the second extension portion are of arc-shaped configurations;

the first extension portion defines a first sealing groove; the second extension portion defines a second sealing groove; the first sealing ring is at least partially located in the first sealing groove; the second sealing ring is at least partially located in the second sealing groove.

4. The compressor according to claim 3, wherein the first sealing ring is in contact with an inner wall of the third channel; the second sealing ring is in contact with the inner wall of the injection hole.

5. The compressor according to claim 1, wherein the communication tube comprises a connecting section which is located between the first extension portion and the second extension portion; a diameter of the connecting section is smaller than a minimum diameter of the first extension portion, and is also smaller than a minimum diameter of the second extension portion.

6. The compressor according to claim 1, further comprising an adapter portion which is at least partially located at an opening of the injection hole; in an axial direction of the communication tube, the adapter portion is configured to limit position of the communication tube.

7. The compressor according to claim 6, wherein the adapter portion comprises a pressing plate which defines a plug-in port; the plug-in port is at least partially in communication with the communication channel; the pressing plate is fixed to an outer wall of the injection hole.

8. The compressor according to claim 7, wherein the adapter portion comprises a connecting tube; a tube cavity of the connecting tube is in communication with the plug-in port; the connecting tube is at least partially located in the injection hole.

9. The compressor according to claim 8, wherein the compressor has a gap which is located between the connecting tube and the communication tube.

10. The compressor according to claim 7, wherein a circumferential side wall of the connecting tube defines an accommodating groove located in the injection hole; the compressor comprises a third sealing ring which is at least partially located in the accommodating groove.

11. The compressor according to claim 7, further comprising a liquid injection valve which is fixed to the outer wall of the injection hole; an outlet of the liquid injection valve is in communication with the plug-in port.

12. A compressor, comprising:

a fixed scroll comprising a bottom plate and a spiral wall, the bottom plate defining an enthalpy increasing channel and a gas discharge hole;

a movable scroll; and a cover body; the cover body defining an injection hole; the cover body and a hole wall of the injection hole being of one piece;

wherein the compressor defines a compression chamber which is at least partially located between the fixed scroll and the movable scroll;

the compressor comprises a communication tube which defines a communication channel; the communication channel is in communication with the enthalpy increasing channel; one end of the communication tube is at least partially located in the enthalpy increasing channel; another end of the communication tube is at least partially located within the injection hole;

the enthalpy increasing channel comprises a first channel and a second channel; an outlet of the first channel and an outlet of the second channel are located on two sides of the gas discharge hole, respectively.

13. The compressor according to claim 12, wherein the compressor comprises a first sealing ring and a second sealing ring;

a circumferential side wall of the one end of the communication tube is connected to the first sealing ring; the first sealing ring is connected to an inner wall of the enthalpy increasing channel;

a circumferential side wall of the another end of the communication tube is connected to the second sealing ring; the second sealing ring is connected to an inner wall of the injection hole.

14. The compressor according to claim 13, wherein a peripheral wall of the communication tube comprises a first extension portion which is of an annular configuration; the first extension portion is at least partially located within the enthalpy increasing channel; the peripheral wall of the communication tube comprises a second extension portion which is of an annular configuration; the second extension portion is at least partially located within the injection hole;

in a plane where a centerline of the communication tube lies, circumferential outer surfaces of the first extension portion and the second extension portion are of arc-shaped configurations;

the first extension portion defines a first sealing groove; the second extension portion defines a second sealing groove; the first sealing ring is at least partially located in the first sealing groove; the second sealing ring is at least partially located in the second sealing groove.

15. The compressor according to claim 14, wherein the enthalpy increasing channel further comprises a third channel; an inlet of the first channel and an inlet of the second channel are both in communication with the third channel; the outlet of the first channel and the outlet of the second channel are in communication with the compression chamber; the first extension portion is at least partially located in the third channel; the first sealing ring is in contact with an inner wall of the third channel; the second extension portion is at least partially located in the injection hole; the second sealing ring is in contact with the inner wall of the injection hole.

16. The compressor according to claim 14, wherein the communication tube comprises a connecting section which is located between the first extension portion and the second extension portion; a diameter of the connecting section is smaller than a minimum diameter of the first extension portion, and is also smaller than a minimum diameter of the second extension portion.

17. The compressor according to claim 12, further comprising an adapter portion which is at least partially located at an opening of the injection hole; in an axial direction of the communication tube, the adapter portion is configured to limit position of the communication tube.

18. The compressor according to claim 17, wherein the adapter portion comprises a pressing plate which defines a plug-in port; the plug-in port is at least partially in communication with the communication channel; the pressing plate is fixed to an outer wall of the injection hole.

19. The compressor according to claim 18, wherein the adapter portion comprises a connecting tube; a tube cavity of the connecting tube is in communication with the plug-in port; the connecting tube is at least partially located in the injection hole.

20. The compressor according to claim 18, further comprising a liquid injection valve which is fixed to the outer wall of the injection hole; an outlet of the liquid injection valve is in communication with the plug-in port.

* * * * *